US011040436B2

(12) United States Patent
Nakagawa

(10) Patent No.: US 11,040,436 B2
(45) Date of Patent: Jun. 22, 2021

(54) TEMPORARY TIGHTENING TOOL FOR FASTENING MEMBER

(71) Applicant: TOYOTA JIDOSHA KABUSHIKI KAISHA, Toyota (JP)

(72) Inventor: Kenji Nakagawa, Miyoshi (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 288 days.

(21) Appl. No.: 16/292,635

(22) Filed: Mar. 5, 2019

(65) Prior Publication Data

US 2019/0275649 A1 Sep. 12, 2019

(30) Foreign Application Priority Data

Mar. 6, 2018 (JP) ..... JP2018-039255

(51) Int. Cl.

| | |
|---|---|
| ***B25B 23/10*** | (2006.01) |
| ***B25B 13/06*** | (2006.01) |
| ***B25B 15/00*** | (2006.01) |
| ***B25B 15/02*** | (2006.01) |

(52) U.S. Cl.

CPC ..... *B25B 23/108* (2013.01); *B25B 13/06* (2013.01); *B25B 15/008* (2013.01); *B25B 23/106* (2013.01); *B25B 15/02* (2013.01)

(58) Field of Classification Search

CPC ..... B25B 13/06; B25B 15/02; B25B 15/008; B25B 23/101; B25B 23/106; B25B 23/108

See application file for complete search history.

(56) References Cited

U.S. PATENT DOCUMENTS

| | | | | |
|---|---|---|---|---|
| 2,798,394 | A * | 7/1957 | Hubbard | B25B 23/108 81/125 |
| 2,800,822 | A * | 7/1957 | Allred | B25B 13/06 81/125 |
| 5,507,211 | A | 4/1996 | Wagner | |
| 5,615,587 | A * | 4/1997 | Foerster, Jr. | B25B 13/06 81/124.2 |
| 6,606,924 | B2 * | 8/2003 | Chandler | B25B 23/10 279/46.1 |
| 7,765,898 | B2 * | 8/2010 | Sakaguchi | B25B 23/10 81/60 |
| 2010/0294087 | A1 * | 11/2010 | Hu | B25B 13/06 81/125 |
| 2018/0062339 | A1 * | 3/2018 | Blake | B25B 13/06 |

FOREIGN PATENT DOCUMENTS

| | | | |
|---|---|---|---|
| EP | 1060843 | A2 | 12/2000 |
| GB | 2295979 | A | 6/1996 |
| JP | 2017-124778 | A | 7/2017 |

* cited by examiner

*Primary Examiner* — David B. Thomas
(74) *Attorney, Agent, or Firm* — Sughrue Mion, PLLC

(57) ABSTRACT

A temporary tightening tool includes a grip part and a socket part into which a bolt head part is inserted. The socket part is formed in a shape of a hexagonal tube surrounded by six side walls, a hook part, which is a leaf spring part, is formed in each of alternate three side walls among the six side walls, and a thick torque transmission part is formed in each of three remaining side walls without the hook part. When the bolt head part is inserted in the socket part, the hook part is elastically deformed, and holds the hold bolt head part with restoring force. Torque input into the grip part is transmitted to the bolt head part from the torque transmission wall.

5 Claims, 12 Drawing Sheets

TEMPORARY TIGHTENING TOOL FOR FASTENING MEMBER

TECHNICAL FIELD

The present invention relates to a temporary tightening tool for a fastening member, which is used for temporarily tightening a fastening member that is a bolt or nut for fastening a tire wheel to a hub.

BACKGROUND ART

A bolt or nut is used as a fastening member for fixing a tire wheel to a hub. Although a manual operation for temporarily tightening a fastening member occurs when attaching and detaching a tire wheel, a temporary tightening tool may be used in order to make the temporary tightening operation easy. For example, a connection type, in which a tire wheel is connected and fixed to a hub by inserting a bolt that is a fastening member through a mounting hole of a tire wheel and screwing a male screw of the bolt into a female screw of a screw hole formed in the hub to tighten them together, has been known.

For example, in Patent Literature 1 (PTL1), a technology, in which a tire wheel is connected and fixed to a hub by tightening a bolt, has been proposed.

In a case of a connection type, in which a bolt is inserted through a mounting hole of a tire wheel and screwed into a screw hole of a hub to tighten them together, it is necessary to engage a male screw at a tip (leading end) of the bolt with a female screw of the screw hole of the hub and manually turn a head part of the bolt (hexagonal columnar part) first. Since a finger cannot enter an entrance of the mounting hole when a diameter of an opening on the entrance side of the mounting hole of the tire wheel is small, a temporary tightening operation cannot be easily done by hand when a shaft length of the bolt is not long enough (when there is not distance enough for the tip of the bolt to reach the screw hole of the hub). Therefore, a temporary tightening tool is used.

For example, in a temporary tightening tool, as shown in FIG. 17, a socket part 1100 is formed at a tip of a grip part 1000. In the socket part 1100, a hexagon socket 1110, into which a head part of a bolt fits, is formed. As shown in FIG. 18, an operator infixes a head part of a bolt HB in the hexagon socket 1110 formed in the socket part 1100, and inserts the bolt HB through a mounting hole of a fire wheel, engages a male screw at a tip of the bolt HB with a female screw of a screw hole of the hub, and rotates the grip part 1000. Thereby, the male screw of the bolt HB is screwed to the female screw of the screw hole of the hub, and a temporary tightening is completed. After the temporary tightening, the tire wheel is firmly connected and fixed to the hub by strongly tightening the bolt HB using a regular fastening tool, such as a wrench.

CITATION LIST

Patent Literature

[PTL1] Japanese Patent Application Laid-Open (kokai) No. 2017424778

SUMMARY OF INVENTION

However, in such a temporary tightening tool, retention capacity for a bolt (performance for holding a head part of a bolt in a socket part) is insufficient, the bolt falls out of the socket part and workability is not good.

In addition, although a temporary tightening tool adapted to a size of a nut can be used also for a vehicle with a connection type in which a tire wheel is connected and fixed to a hub by tightening the nut, the same problem may arise since the retention capacity of the nut is insufficient.

The present invention has been made in order to cope with the above-mentioned problem, and an objective of the present invention is to improve workability.

In order to attain the above-mentioned objective, a temporary tightening tool for a fastening member according to the present invention is a temporary tightening tool for a fastening member, which is used for temporarily tightening a fastening member that is a bolt or nut for fastening a tire wheel to a hub, comprising:

a grip part (10, 100, 300) for an operator to input torque, and a socket part (20, 200, 400) formed at a tip of said grip part, into which a hexagonal columnar part (HB1) formed at said fastening member (HB) is inserted, wherein:

said socket part comprises:

a leaf spring part (42, 52, 405) which is pressed by a part of six side surfaces of said hexagonal columnar part (HB1) to be elastically deformed outward in a radial direction of said hexagonal columnar part, and presses said part of said six side surfaces inward in the radial direction with restoring force to hold said hexagonal columnar part such that said hexagonal columnar part is clamped, when said hexagonal columnar part is inserted in said socket part, and a torque transmission part (30, 404) which transmits torque to a side surface that is not pressed by said leaf spring part among said six side surfaces of said hexagonal columnar part when said torque is input into said grip part in a state where said hexagonal columnar part has been inserted in said socket part.

The temporary tightening tool for a fastening member according to the present invention is a tool used when an operator temporarily tightens a fastening member that is a bolt or nut for fastening a tire wheel to a hub. This temporary tightening tool for a fastening member has a grip part and a socket part. The grip part is a part for an operator to input torque. The socket part is a part, in which a hexagonal columnar part formed in the fastening member is inserted, and which transmits the torque input to the grip part to the fastening member while holding the fastening member. For example, it is preferable that the grip part and socket part are integrally formed of resin or a metallic plate.

This socket part comprises a leaf spring part and a torque transmission part. When the hexagonal columnar part is inserted therein, the leaf spring part is pressed by a part of six side surfaces of the hexagonal columnar part to be elastically deformed outward in a radial direction of the hexagonal columnar part, and presses the part of the six side surfaces inward in the radial direction with restoring force to hold the hexagonal columnar part so as to clamp the hexagonal columnar part.

The torque transmission part transmits torque to a side surface that is not pressed by the leaf spring part among the six side surfaces of the hexagonal columnar part, when the torque is input into the grip part in a state where the hexagonal columnar part has been inserted in the socket part. Therefore, the torque transmission part receives reaction force (counterforce) against the torque from the fastening member. In this case, even when torque is input into the leaf spring part from the grip part, since the leaf spring part is elastically deformed to evacuate, the leaf spring part can transmit the majority of the torque to the fastening member from the torque transmission part. Therefore, retention function (holding function) for the fastening member can be shared with the leaf spring part, and torque transmission function to the fastening member can be shared with the torque transmission part. Thereby, since the leaf spring part hardly receives the reaction force from the fastening member accompanying torque input, excellent spring property can be maintained.

As a result, in accordance with the present invention, the retention capacity for a fastening member can become excellent, and workability can be improved.

Another feature of the present invention is in that:

said socket part (20, 200) is formed in a shape of a hexagonal tube surrounded by six side walls (11), two slits (41, 51) are formed a predetermined dimension away from each other in a width direction to reach a tip of said side wall along an axis direction in each of alternate three side walls among said six side walls, said leaf spring part (42, 52) is a plate body formed between said two slits, and said torque transmission part (30) is prepared in each of three remaining side walls without said slits among said six side walls, in which a thick part (31) with plate thickness thicker than said leaf spring part is formed.

As another feature of the present invention, the socket part is formed in a shape of a hexagonal tube surrounded by six side walls, two slits are formed a predetermined dimension away from each other in a width direction to reach a tip of the side wall along an axis direction in each of three side walls alternate in a circumferential direction among the six side walls. A plate body formed between the two slits can swing in the radial direction making a region between edges (start points) of the two slits as a base (fulcrum). Therefore, the plate body between the two slits functions as a leaf spring part which can be elastically deformed by force in the radial direction.

The torque transmission part is prepared in each of three remaining side walls without the slits among the six side walls, a thick part with plate thickness thicker than the leaf spring part is formed therein. Therefore, the reaction force from the fastening member accompanying torque input can be received properly.

For example, the grip part may be configured such that the grip part has a hexagonal tubular part formed in a shape of a hexagonal tube surrounded by six side walls, the slits are formed in three side walls at the tip of this hexagonal tubular part of the grip part, and the thick part is formed at the tip of each of the remaining three side walls. Thereby, the tip of the grip part can be configured as the socket part. Moreover, it is preferable that the temporary tightening tool for a fastening member has the grip part and the socket part integrally formed of resin.

In this case, it is preferable that said leaf spring part is formed in a shape in which a tip side of said plate body between said slits is inclined inward in the radial direction, and is configured such that this inclined tip of said plate body presses the side surface of said hexagonal columnar part inward in the radial direction.

Alternatively, it is preferable that said leaf spring part is formed in a shape in which said plate body between said slits is bent inward in the radial direction in a shape of a U character, and is configured such that this tip of said plate body bent in the shape of a U character presses the side surface of said hexagonal columnar part inward in the radial direction.

In accordance with this invention, elastic deformation of the leaf spring part outward in the radial direction of the hexagonal columnar part can be made to occur successfully and, in association with this, the restoring force for clamping the hexagonal columnar part with the leaf spring part can be generated successfully. Thereby, retention capacity of the fastening member can become excellent, and workability can be improved.

Another feature of the present invention is in that:

said socket part (400) comprises a socket substrate (402) that is a metallic plate in a shape of a ring with an insertion hole (401), into which said hexagonal columnar part is inserted, said leaf spring part (405) is formed in a shape which is bent from a plurality of predetermined positions in an inner periphery (403) surrounding said insertion hole of said socket substrate to be extended in a direction, into which said hexagonal columnar part is inserted, said torque transmission part (404) is formed at a position in said inner periphery of said socket substrate where said leaf spring part is not formed, and said grip part (300) is formed in a shape which is bent from an outer periphery (406) of said socket substrate to be extended in a direction, into which said hexagonal columnar part is inserted.

In the present invention, the socket part comprises a socket substrate that is a metallic plate in a shape of a ring with an insertion hole, into which the hexagonal columnar part is inserted. The leaf spring part is formed in a shape which is bent from a plurality of predetermined positions in an inner periphery surrounding the insertion hole of the socket substrate to be extended in a direction, into which the hexagonal columnar part is inserted, and is elastically deformed outward in the radial direction of the hexagonal columnar part making the socket substrate as a base (using a part, at which the socket substrate and the leaf spring part are connected continuously, as a fulcrum) when the hexagonal columnar part is inserted in the insertion hole, and holds the hexagonal columnar part with its restoring force such that the hexagonal columnar part is clamped (sandwiched).

The torque transmission part is formed at a position in the inner periphery of the socket substrate where the leaf spring part is not formed. The grip part is formed in a shape which is bent from an outer periphery of the socket substrate and extended in a direction, into which the hexagonal columnar part is inserted.

Therefore, the grip part can be easily formed integrally with the socket part. In this case, it is preferable that the temporary tightening tool for a fastening member is formed by processing spring steel or stainless steel material, for example.

Moreover, it is preferable that:

said torque transmission part comprises two linear edges (404) formed in a linear shape and facing in parallel with each other in said inner periphery of said socket substrate and configured so as to transmit torque to two mutually parallel side surfaces among said six side surfaces of said hexagonal columnar part when said torque is input into said grip part in a state where said hexagonal columnar part is inserted in said insertion hole, and said leaf spring part (405) is configured to be pressed by four side surfaces, excluding said two mutually parallel side surfaces, among said six side surfaces of said hexagonal columnar part to be elastically deformed outward in the radial direction of said hexagonal columnar part when said hexagonal columnar part is inserted in said insertion hole, and so as to press said four side surfaces inward in the radial direction with restoring force to hold said hexagonal columnar part such that said hexagonal columnar part is clamped.

In accordance with this configuration, since torque is input into the two parallel side surfaces among the six side surfaces of the hexagonal columnar part from the torque transmission part, the torque can be successfully transmitted to the hexagonal columnar part. Moreover, four remaining side surfaces among the six side surfaces of the hexagonal columnar part can be held by the leaf spring part. Therefore, since the leaf spring part presses two pairs of mutually parallel side surfaces among the six side surfaces of the hexagonal columnar part with its own restoring force, the fastening member can be held stably.

In addition, although reference signs used in explanations of embodiments of the present invention are attached in parenthesis to constituents of the invention corresponding to the embodiments in the above-mentioned explanation in order to help understanding of the invention, respective constituents of the invention are not limited to the embodiments specified with the above-mentioned reference signs.

DESCRIPTION OF EMBODIMENTS

First Embodiment

Figure 1:
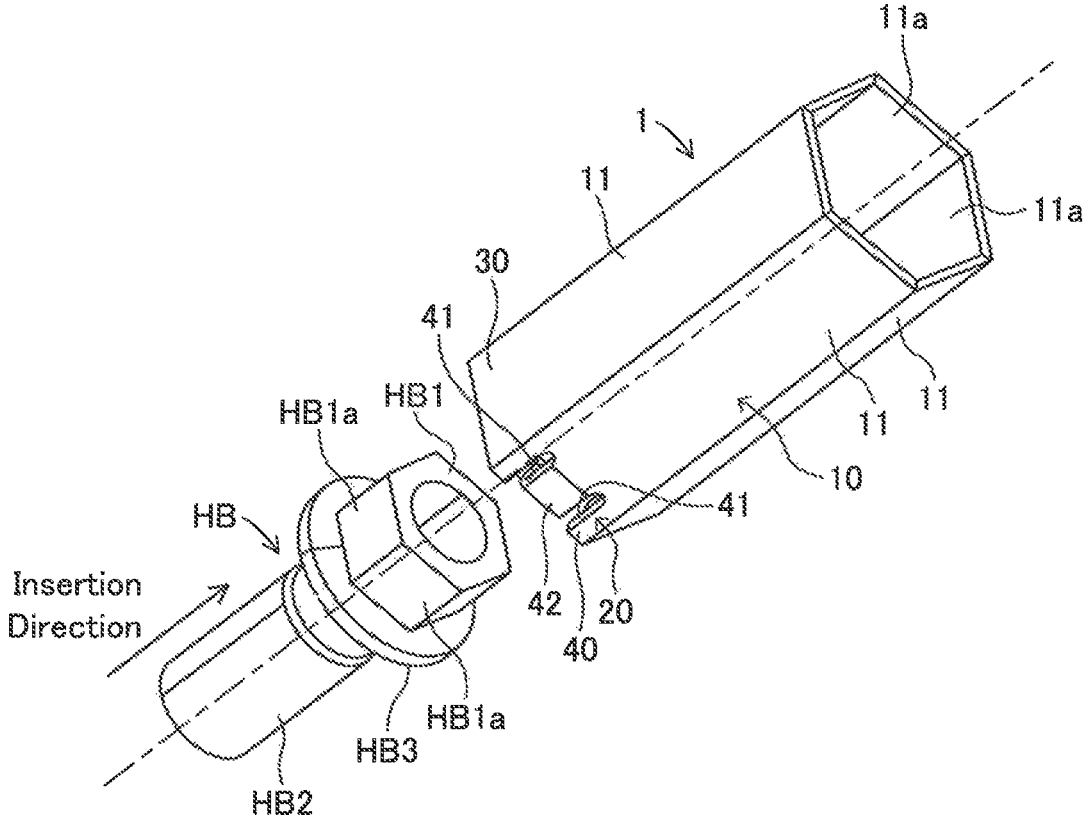
FIG. 1 is a perspective view of a temporary tightening tool for a fastening member according to a first embodiment.
Figure 2:
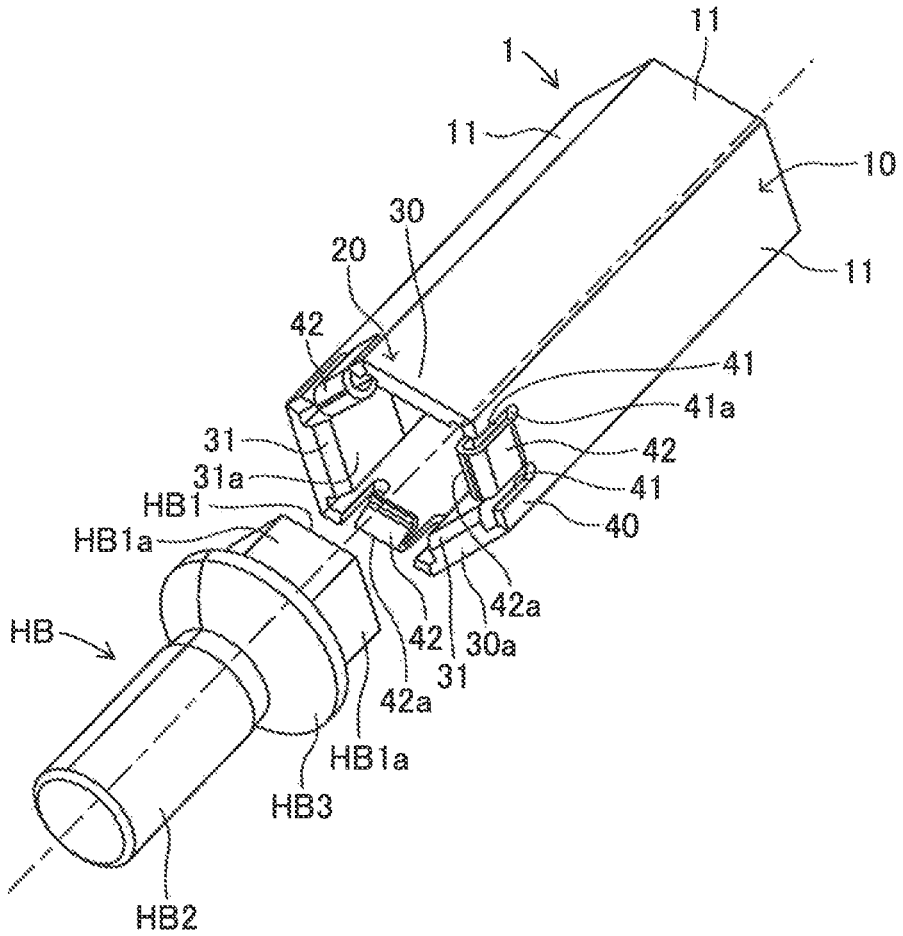
FIG. 2 is another perspective view of the temporary tightening tool for a fastening member according to the first embodiment.
Figure 3:
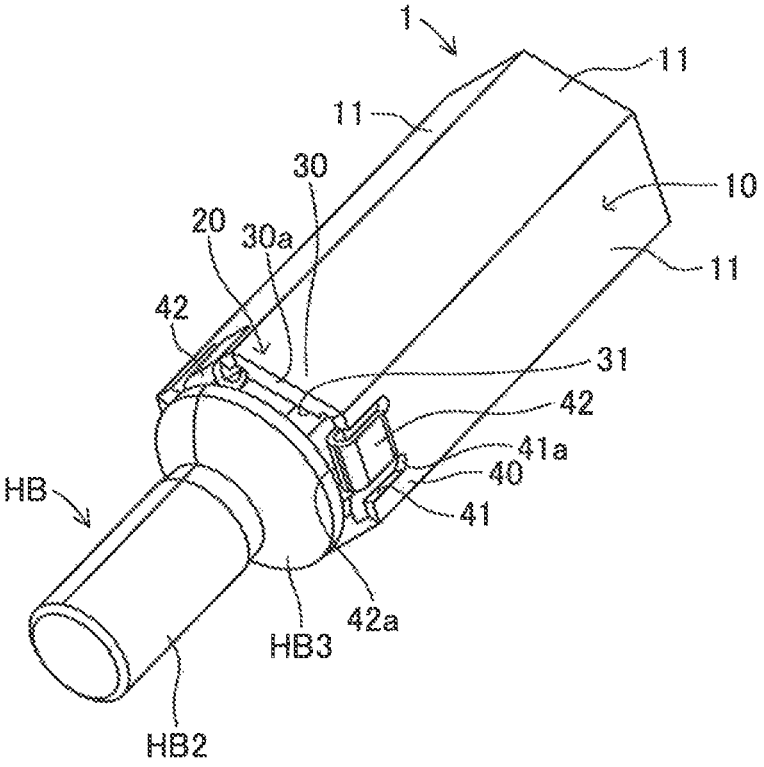
FIG. 3 is a perspective view for showing a state where a hub bolt is inserted into a tip of the temporary tightening tool for a fastening member according to the first embodiment.
Figure 4:
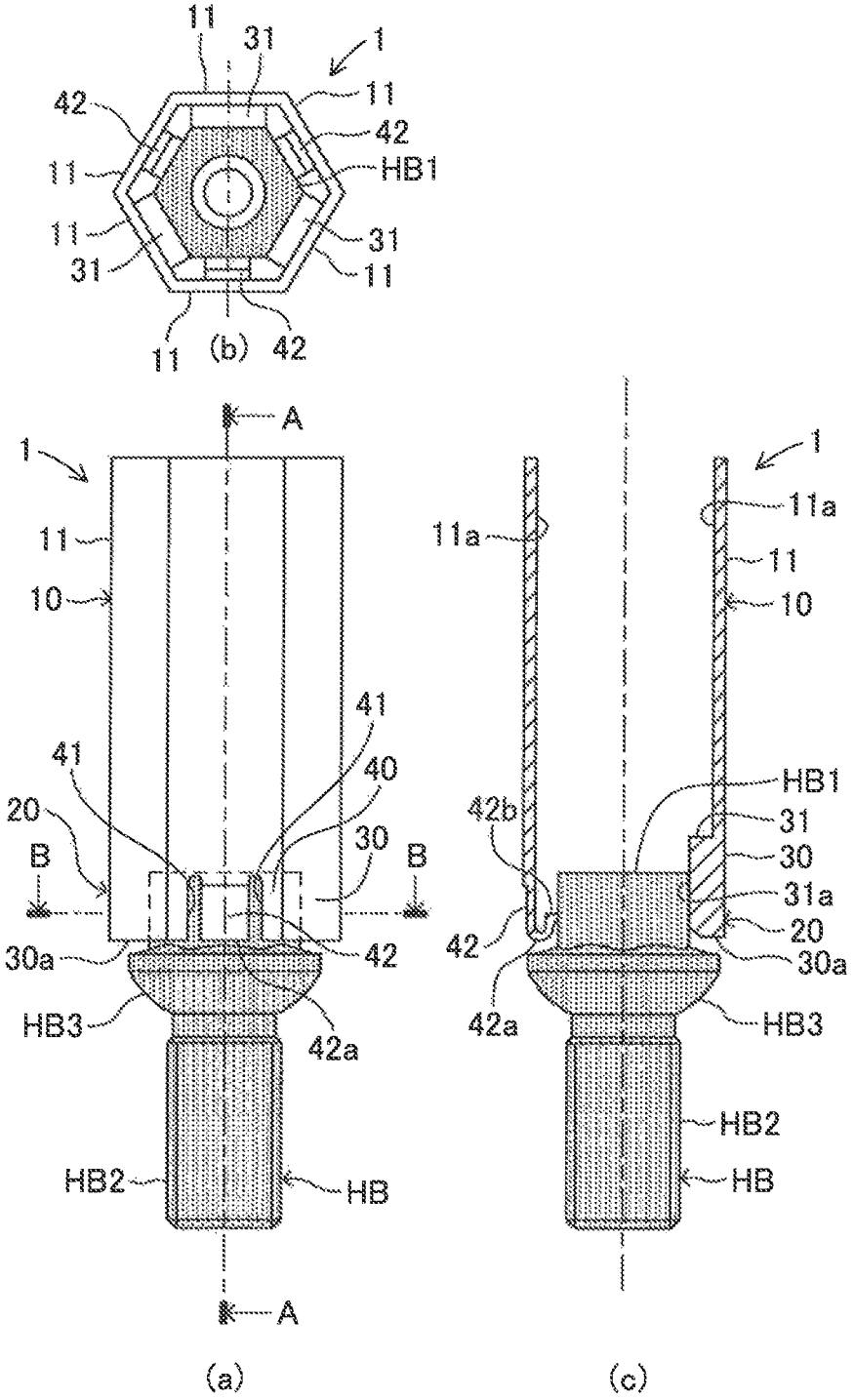
FIG. 4 includes a front elevation, a plan view and an axial sectional view of the temporary tightening tool for a fastening member according to the first embodiment.
Figure 5:
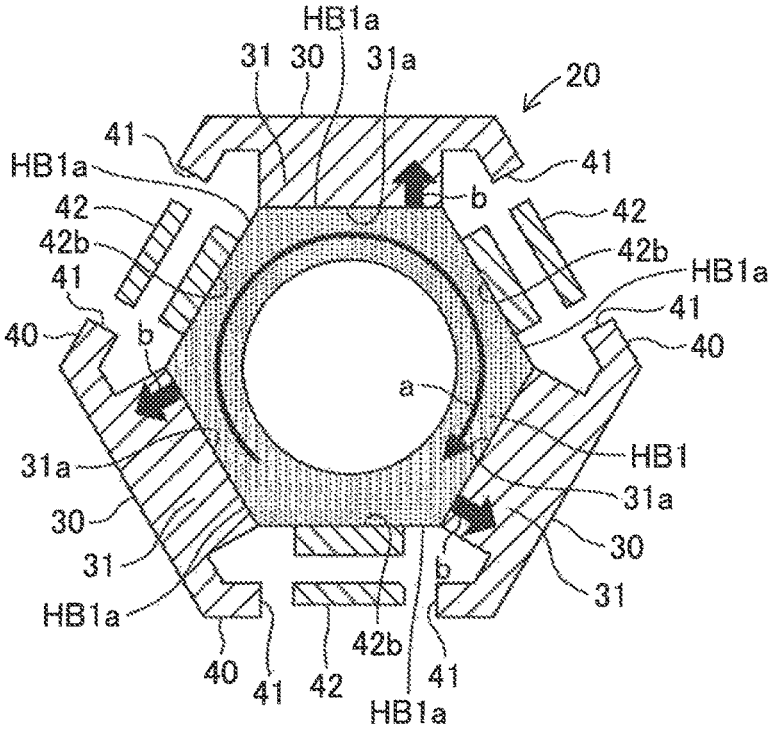
FIG. 5 is a sectional view in a radial direction of the temporary tightening tool for a fastening member according to the first embodiment.
Figure 6:
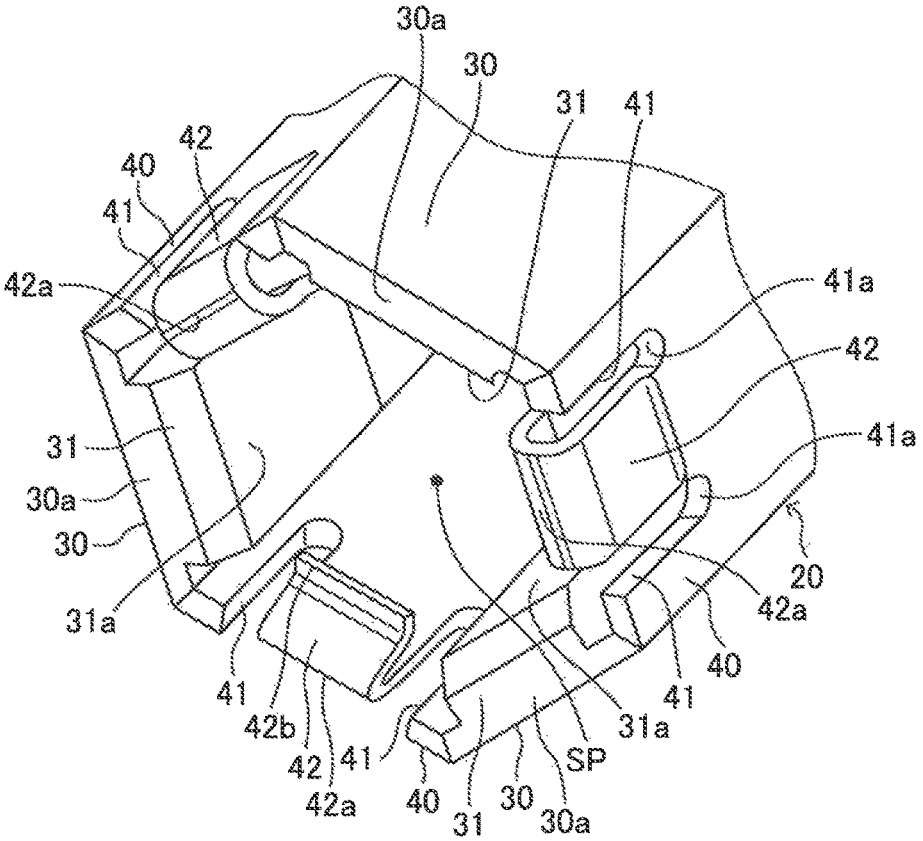
FIG. 6 is an enlarged perspective view of a socket part of the temporary tightening tool for a fastening member according to the first embodiment.

Hereafter, a temporary tightening tool for a fastening member according to an embodiment of the present invention will be explained referring drawings. FIG. 1 to FIG. 6 are drawings for showing a temporary tightening tool for a fastening member according to a first embodiment, and FIG. 1 and FIG. 2 are perspective views for showing the temporary tightening tool for a fastening member observed from two different directions, and FIG. 3 is a perspective view for showing a state where a hub bolt is inserted in a tip of the temporary tightening tool for a fastening member. Moreover, FIG. 4 is a diagram for showing a state where a hub bolt is inserted in a tip of the temporary tightening tool for a fastening member, and (a) is a front elevation, (b) is a plan view and (c) is a sectional view at a disconnection line A-A. FIG. 5 is a sectional view at a disconnection line B-B in (a) of FIG. 4. FIG. 6 is an enlarged perspective view of a tip of the temporary tightening tool for a fastening member. In addition, in FIG. 4 and FIG. 5, a hub bolt is indicated in gray in order to make it easier to distinguish the temporary tightening tool for a fastening member and the hub bolt.

Figure 7:
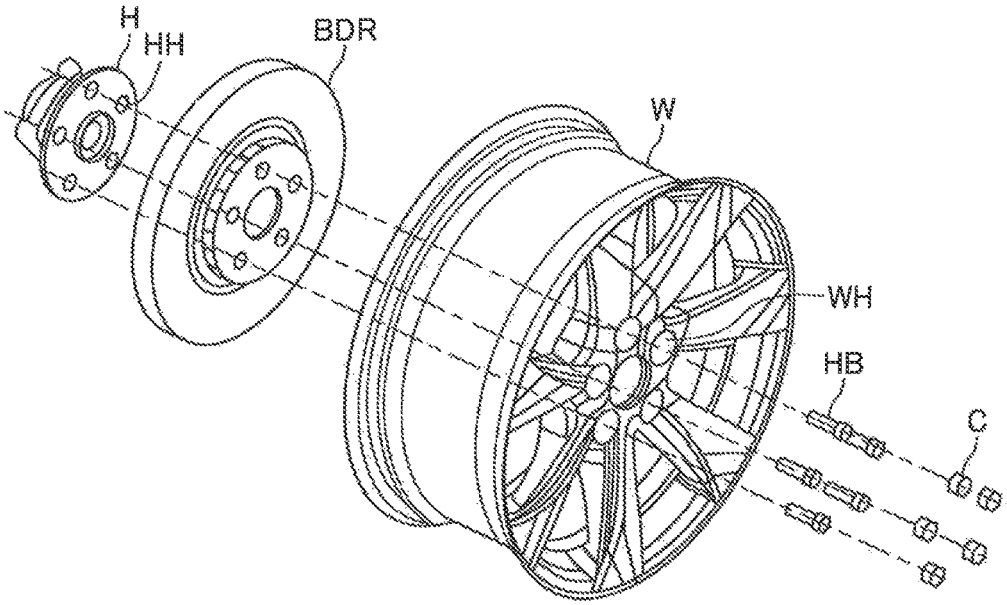
FIG. 7 is an exploded perspective view for showing a structure for connecting a fire wheel with a hub.

A temporary tightening tool for a fastening member (which will be simply referred to as a temporary tightening tool) is a tool for temporarily tightening a hub bolt when attaching and detaching a tire wheel. As shown in FIG. 7, a tire wheel W is connected and fixed to a hub H (hub bearing) by inserting a hub bolt HB into a wheel mounting hole WH and screwing and tightening a hub bolt HB to a screw hole HH (which will be referred to as a hub screw hole HH) of the hub H. In the drawing, a reference sign BDR expresses a brake disc rotor, and a reference sign C expresses a decoration resin cap. Although a state where the brake disc rotor BDR is removed from the hub H in order to show the hub screw hole HH in FIG. 7, the brake disc rotor BDR is fixed to the hub H by a fixing member which is not illustrated, and the brake disc rotor BDR will not be taken off when attaching and detaching the tire wheel W.

Although a manual operation for temporarily tightening the hub bolt HB occurs when attaching and detaching the fire wheel W, since a finger cannot enter an entrance of the wheel mounting hole WH when a diameter of an opening on the entrance side of the wheel mounting hole WH is small, a temporary tightening operation cannot be easily done by hand when a shaft length of the hub bolt HB is not long enough (when there is not distance enough for the tip of the hub bolt HB to reach the hub screw hole HH).

The temporary tightening tool according to this embodiment is a tool for make it easier to temporarily tighten the hub bolt HB even in such a situation.

As shown in FIG. 1 to FIG. 6, the temporary tightening tool 1 is an integrated object (one member) formed in a shape of a hexagonal tube with resin, and is constituted by a grip part 10 and a socket part 20 formed at a tip of the grip part 10. The grip part 10 is a part, at which an operator grasps the temporary tightening tool 1, and it is a part formed in a shape of a hexagonal tube, to which torque is input from the operator when temporarily tightening. The socket part 20 is a part, into which a head part HB1 of the hub bolt HB is inserted when temporarily tightening to transmit the torque input into the grip part 10 to the head part HB1 of the hub bolt HB.

The hub bolt HB is equivalent to the fastening member in the present invention, and is constituted by the head part HB1 formed in the shape of a hexagonal column, a columnar screw part HB2 with a male screw formed on its outer periphery, and a flange part HB3 prepared between the head part HB1 and the screw part HB2. The screw part HB2 is a part to be screwed to the hub screw hole HH. The head part HB1 is a part equivalent to the hexagonal columnar part in the present invention, into which torque is input by the various tools including the temporary tightening tool 1. The flange HB3 is a part which comes into contact with a tapered inner periphery surface formed on the entrance side of the wheel mounting hole WH to push the tire wheel W on to the hub H. The wheel mounting hole WH has a tapered inner periphery surface where an inner diameter on an outer side in a car width direction (entry side) is larger than an inner diameter on an inner side in the car width direction. The flange part HB3 is arranged at the entry side in the wheel mounting hole WH, and pushes the tapered inner periphery surface of the wheel mounting hole WH. Hereafter, the head part HB1 of the hub bolt HB will be referred to as a bolt head part HB1.

The grip part 10 comprises six flat walls 11 which constitute a hexagonal tubular body. The socket part 20 is formed at the tip of the grip part 10 continuously with the grip part 10.

The socket part 20 comprises torque transmission walls 30 and leaf spring walls 40 at the tips of the six side walls 11 of the hexagonal tubular body which constitutes the grip part 10 by turns in a circumferential direction. Therefore, the socket part 20 is formed in a shape of a hexagonal tube, in which the torque transmission walls 30 and the leaf spring walls 40 are arranged by turns in a circumferential direction. As shown in FIG. 6, space SP surrounded by the torque transmission walls 30 and the leaf spring walls 40 is formed in the socket part 20 to be in a shape of a hexagonal tube. This space SP is a room where the bolt head part HB1 is inserted. Hereafter, this space RP will be referred to as a head insertion space SP.

Each of the torque transmission walls 30 comprises a thick part 31 formed continuously with the side wall 11 of the grip part 10, whose internal wall surface protrudes inside the internal wall surface 11*a* of the side wall 11 of the grip part 10 (refer to FIG. 4(*c*)). The external wall surface of the torque transmission wall 30 is formed so as to be connected smoothly with the external wall surface of the side wall 11 of the grip part 10. This thick part 31 is prepared at a center position in a width direction of the torque transmission wall 30. The internal wall surface 31*a* of the thick part 31 is evenly formed in parallel with the internal wall surface 11*a* of the side wall 11 of the grip part 10. Therefore, the internal wall surfaces 31*a* of the thick part 31 are formed so as to constitute three sides (alternate three sides) of a regular hexagon in an axial directional view.

The above-mentioned regular hexagon is a regular hexagon an interference smaller than a shape of an outer perimeter line of a cross-section of the bolt head part HB1 in its radial direction. This interference is an interference for the thick part 31 to tighten the side surface of the bolt head part HB1 when the bolt head part HB1 is inserted in the socket part 20, and is set to a minute dimension. Moreover, chamfering is given to the internal wall side of the tip of the thick part 31. Thereby, even though the above-mentioned interference is prepared, the bolt head part HB1 can be easily inserted into the socket part 20.

In addition, in the present specification, an axis direction expresses a direction, to which a central axis line of the temporary tightening tool 1 formed in a shape of a hexagonal tube is oriented, and a radial direction expresses a direction which intersects perpendicularly with the axis direction. Moreover, the hub bolt HB is kept in a positional relation in which the hub bolt HB is coaxial with the temporary tightening tool 1 in a state where the hub bolt HB is inserted in the socket part 20.

A pair of two slits 41 are formed to reach a tip of each of the three leaf spring walls 40. Each of the slits 41 is an opening cut off to be narrow and long in a linear shape. The two slits 41 for each of the leaf spring walls 40 are formed a predetermined dimension away from each other in a width direction and parallel with each other. The leaf spring walls 40 express the side walls 11 in regions with the slits 41 formed therein among the six walls 11.

The leaf spring wall 40 is formed in a shape in which a tip side of a plate body between the two slits 41 is bent inward in the radial direction in a shape of a U character and extended in the insertion direction of the bolt head part HB1. This U-shaped plate body prepared between the two slits 41 can swing in the radial direction making a region between edges 41*a* of the two slits 41 as a base (fulcrum). Therefore, the U-shaped plate body prepared between the two slits 41 functions as a leaf spring part which can be elastically deformed by force in the radial direction. This U-shaped plate body prepared between the two slits 41 is equivalent to the leaf spring part in the present invention. Hereafter, the U-shaped plate body equivalent to the leaf spring part will be referred to as a hook part 42.

The three hook parts 42 have a shape identical with each other, and their thickness is formed thinner than the thickness of the side wall 11 of the grip part 10. The part bent in a shape of a U character of the hook part 42 (which will be referred to as a nail turn-up part 42*a*) is formed at the same position in the axis direction as the tip of the torque transmission wall 30 (which will be referred to as a torque transmission wall tip 30*a*). Therefore, an entry where the bolt head part HB1 is inserted is formed of the three nail turn-up parts 42*a* and the three torque transmission wall tips 30*a*.

A tip 42*b* (tip after being turned up in the shape of a U character) of the hook part 42 is formed in a shape slightly bent inward in the radial direction. This tip 42*b* of the hook part 42 is a part which presses a side surface HB1*a* of the bolt head part HB1 inward in the radial direction as will be mentioned later. Hereafter, the Up 42*b* of the hook part 42 will be referred to as a hook pressing part 42*b*. End sides on an inner side in the radial direction of the three hook pressing parts 42*b* are formed so as to constitute three sides (alternate three sides) of a regular hexagon in an axial directional view.

The above-mentioned regular hexagon is a regular hexagon smaller than a shape of an outer perimeter line of a cross-section of the bolt head part HB1 in its radial direction. Therefore, the hook parts 42 are pressed by three side surfaces (a part of the side surfaces in the present invention) among the six side surfaces HB1*a* of the bolt head part HB1 to be elastically deformed outward in the radial direction when the bolt head part HB1 is inserted into the head insertion space SP of the socket part 20, and impart their restoring force to the three side surfaces HB1*a*. For this reason, the three hook parts 42 clamp the bolt head part HB1 with their own ((leaf spring's) restoring force from three directions (three directions at equal intervals in a circumferential direction) to hold the bolt head part HB1.

As shown in FIG. 4(*c*), the length in the axis direction from the nail turn-up part 42*a* to the hook pressing part 42*b* in the hook part 42 is shorter than the length in the axis direction of the bolt head part HB1, and is about half of the length in the axis direction of the bolt head part HB1, for example. On the other hand, the length in the axis direction of the thick part 31 in the torque transmission wall 30 is longer than the length in the axis direction of the bolt head part HB1.

The maximum outside diameter of the socket part 20 is set to be smaller than the diameter of an opening on the entry side of the wheel mounting hole WH. Therefore, the tip of the socket part 20 can be inserted into the entry of the wheel mounting hole WH.

An operator inserts the bolt head part HB1 into the socket part 20 of this temporary tightening tool 1, when temporarily tightening the hub bolt HB (namely, when temporarily tightening the tire wheel W to the hub H). By this insertion operation, the bolt head part HB1 comes into contact with the internal side surface of the hook part 42. Thereby, the hook part 42 is elastically deformed to spread outward in the radial direction. And, when the tip of the bolt head part HB1 reaches the hook pressing part 42*b*, the hook pressing part 42*b* will be pushed outward in the radial direction by the bolt head part HB1 thereafter. Therefore, the bolt head part HB1 comes to be in a state where the three side surfaces HB1*a* are pressed inward in the radial direction by the hook pressing parts 42*b* with the restoring force of the hook parts 42.

This dimension by which the hook pressing parts 42*b* spread outward in the radial directions is the interference of the hook parts 42. There is variation in the width-across-flats dimension of the bolt head part HB1. The interference of the hook parts 42 is set hi consideration of variation in the width-across-flats dimension of the bolt head part HB1. Since the hook parts 42 are leaf springs, interference sufficient for absorbing the variation in the dimension of the bolt head part HB1 can be set. Especially, since the hook part 42 of the temporary tightening tool 1 of this first embodiment is turned up in the shape of a U character, the hook part 42 is elastically deformed not only in the radial direction making a base (region between edges 41*a* of the two slits 41) as a fulcrum, but also hi the radial direction making fulcrum the nail turn-up part 42*a* bent in the shape of a U character as a fulcrum. Therefore, its spring modulus can be made smaller, distortion can be suppressed, and a desired set load (pressing force) can be generated.

In this way, the bolt head part HB1 is stably held by the three hook parts 42 after being inserted in the socket part 20.

In a state where the bolt head part HB1 is inserted in the socket part 20, the side surface HB1*a* of the bolt head part HB1 is pressed against the internal side surface of the torque transmission wall 30 (internal wall surface 31*a* of the thick part 31) by the interference of the thick part 31.

However, the pressed state differs depending on the variations in manufactured dimensions of the socket part 20 and the bolt head part HB1. For this reason, there is a possibility that the side surface HB1*a* of the bolt head part HB1 cannot be pressed against the internal wall surface 31*a* of the torque transmission wall 30. Moreover, there is a possibility that the internal wall surface 31*a* of the torque transmission wall 30 is worn out by repetitive use of the temporary tightening tool and the side surface HB1*a* of the bolt head part HB1 cannot be pressed against the internal wall surface 31*a* of the torque transmission wall 30. Therefore, the torque transmission wall 30 does not necessarily have a function to stably clamp and hold the bolt head part HB1.

In addition, as a modification, a minute gap may be prepared between the side surface HB1*a* of the bolt head part HB1 and the internal wall surface 31*a* of the torque transmission wall 30 such that the side surface HB1*a* of the bolt head part HB1 and the internal wall surface 31*a* of the torque transmission wall 30 do not contact with each other in a state where the bolt head part HB1 is inserted in the socket part 20.

Figure 8:
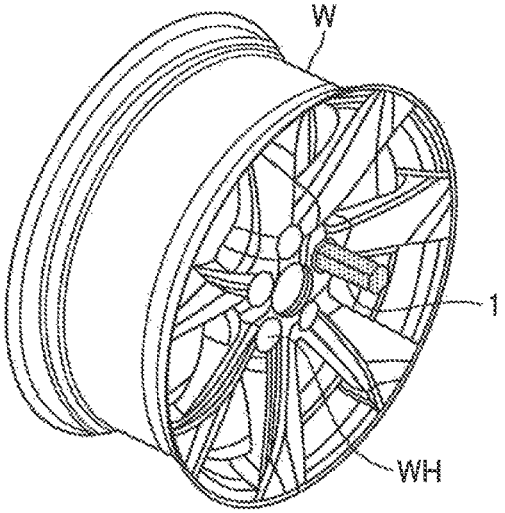
FIG. 8 is a diagram for showing an example of use of the temporary tightening tool for a fastening member.

In the state where the bolt head part HB1 is inserted in the socket part 20, an operator inserts the hub bolt HB through the mounting hole WH of the tire wheel W, aligns the tip of the hub bolt HB to the hub screw hole HH, and rotates the grip part 10 around the axial center. Torque input into the grip part 10 by this is transmitted to the bolt head part HB1 in the socket part 20. Since the socket part 20 can be inserted into the entry of the mounting hole WH of the tire wheel W at this time as shown in FIG. 8, the tip of the hub bolt HB can be made to reach the hub screw hole HH even when a shaft length of the hub bolt HB is not long enough.

In this case, when the side surfaces HB1*a* of the bolt head part HB1 touch the internal wall surfaces 31*a* of the torque transmission wall 30 at a time point when the bolt head part HB1 is inserted into the socket part 20, the torque can be transmitted to the torque transmission walls 30 and the bolt head part HB1 can be rotated together with the socket part 20 from the moment when the grip park 10 is begun to be rotated. Moreover, since the torque transmission walls 30 can receive reaction force of the bolt head part HB1, the hook parts 42 can be prevented from receiving the reaction force from the bolt head part HB1. Therefore, the hub bolt HB can be rotated, without the hook parts 42 being twisted by the input of the torque.

On the other hand, in a case where the side surfaces HB1*a* of the bolt head part HB1 do not touch the internal wall surfaces 31*a* of the torque transmission walls 30 at the time point when the bolt head part HB1 is inserted into the socket part 20 (including a case where a minute gap is prepared between the side surface HB1*a* and the internal wall surface 31*a* like the above-mentioned modification), the torque input into the grip part 10 is first transmitted to the bolt head parts HB1 from the hook parts 42. When the torque is input into the grip part 10, the hook parts 42 push the bolt head part HB1 in a direction of the torque, receive the reaction force from the bolt head part HB1 in association with this, and are twisted to the direction of the reaction force (elastically deformed).

And, the internal wall surfaces 31*a* of the torque transmission walls 30 come into contact with the bolt head part HB1 at a stage where the hook parts 42 are slightly twisted to the direction of the reaction force. Therefore, the torque transmission walls 30 can receive the reaction force of the bolt head part HB1 from the time point when the internal wall surfaces 31*a* of the torque transmission walls 30 come into contact with the bolt head part HB1. For example, as shown in FIG. 5, when the grip part 10 is turned to the direction of the arrow a, the reaction force of the bolt head part HB1 is input into the torque transmission walls 30 as shown by the arrows b, and is received by the torque transmission walls 30. Thereby, the hook parts 42 do not receive any more reaction force from the time point when the internal wall surfaces 31*a* of the torque transmission walls 30 come into contact with the side surfaces HB1*a* of the bolt head part HB1. Therefore, the hook parts 42 can be regulated not to receive large reaction force from the bolt head part HB1.

In this way, the torque can be transmitted to the bolt head part HB1 using the thick parts 31 of the torque transmission walls 30 to tighten the hub bolt HB to the hub screw hole HH. Therefore, since the hook parts 42 are not used to tighten the hub bolt HB to the hub screw hole HH, the hook parts 42 hardly receive the reaction force of the input torque from the bolt head part HB1. For this reason, permanent set (settling) and abrasion of the hook parts 42 can be reduced.

As a result, in accordance with the temporary tightening tool 1 according to the first embodiment, since the retention capacity for holding the hub bolt HB by the hook parts 42 can be properly maintained, the hub bolt HB will not fall out of the socket part 20 in the temporary tightening operation, and workability can be improved.

When all of six walls of the socket part 20 are made into a torque transmission part without preparing the leaf spring wall 40 as a comparative example, for example, even when an interference part is prepared in the torque transmission part, the interference part is worn out (abrasion of resin) by repetitive use, and desired retention capacity for holding the hub bolt HB cannot be maintained. For example, the interference part can be constituted by convex parts formed in the internal wall surface of the torque transmission part to be projected inward in the radial direction.

On the contrary, in accordance with the temporary tightening tool 1 according to the first embodiment, since the function to hold the hub bolt HB is shared with the hook parts 42 and torque transmission function to the hub bolt HB (which is also a function to receive the reaction force) is shared with the torque transmission walls 30, durability of the hook parts 42 can be raised and the retention capacity for holding the hub bolt HB can be maintained properly.

Second Embodiment

Figure 9:
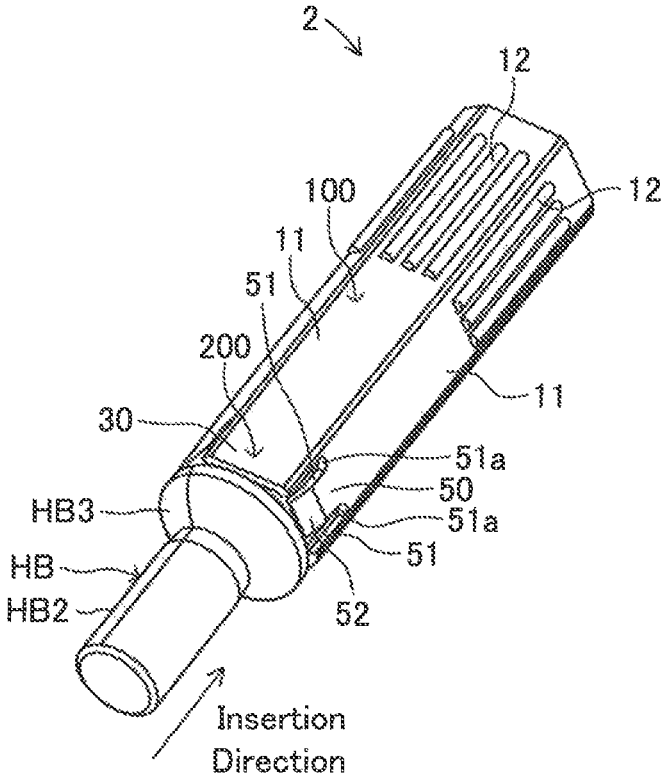
FIG. 9 is a perspective view for showing a state where a hub bolt is inserted into a tip of a temporary tightening tool for a fastening member according to a second embodiment.
Figure 10:
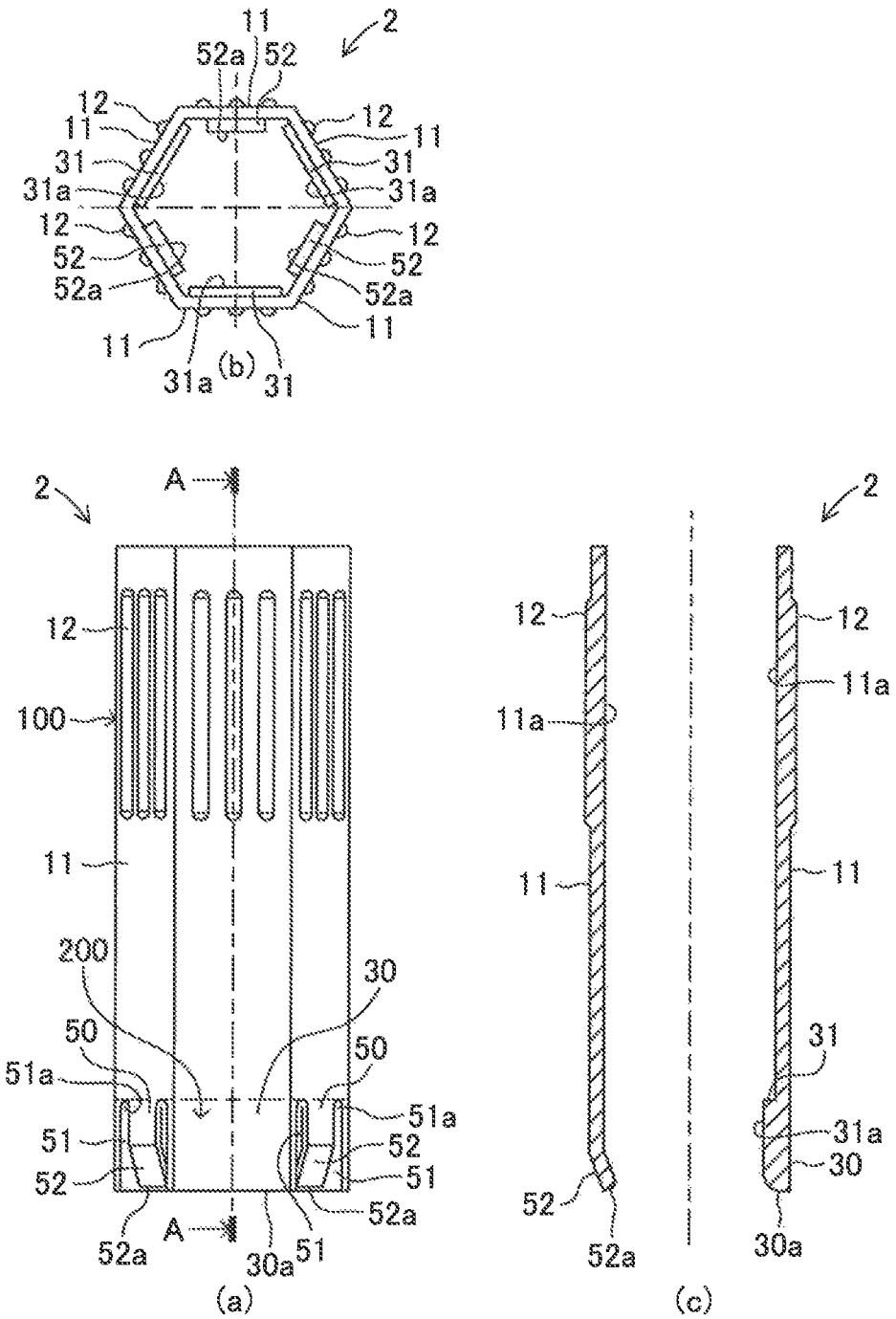
FIG. 10 includes a front elevation, a plan view and an axial sectional view of the temporary tightening tool for a fastening member according to the second embodiment.
Figure 11:
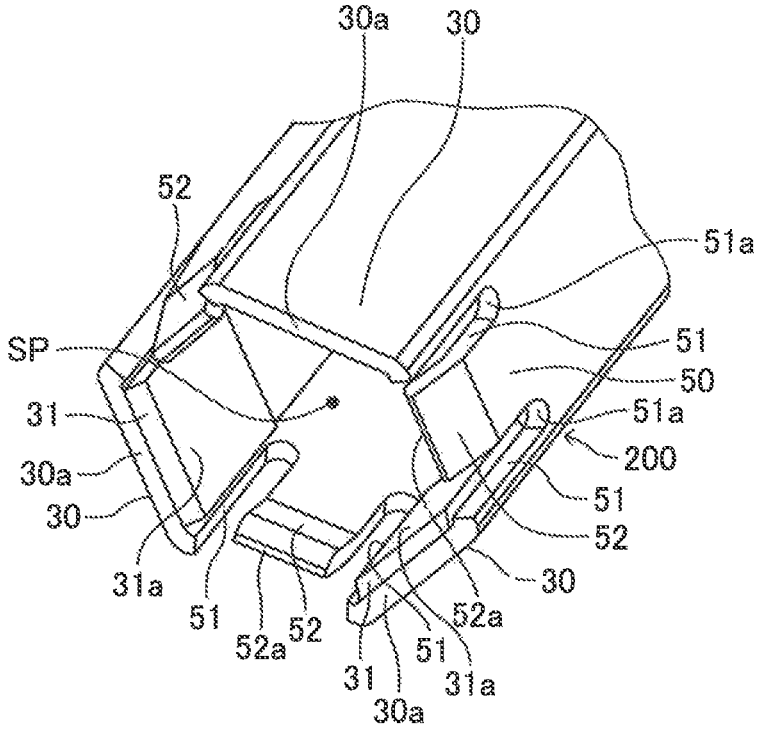
FIG. 11 is an enlarged perspective view of a socket part of the temporary tightening tool for a fastening member according to the second embodiment.

Next, a second embodiment of the temporary tightening tool will be explained. FIG. 9 to FIG. 11 are drawings for showing a temporary tightening tool for a fastening member according to the second embodiment, and FIG. 9 is a perspective view for showing a state where a hub bolt is inserted in a tip of the temporary tightening tool for a fastening member. FIG. 10(*a*) is a front elevation of the temporary tightening tool for a fastening member, FIG. 10(*b*) is a plan view of the temporary tightening tool for a fastening member, and FIG. 10(*c*) is a sectional view at a disconnection line A-A of the temporary tightening tool for a fastening member. FIG. 11 is an enlarged perspective view of a tip of the temporary tightening tool for a fastening member. Hereafter, as for parts having the same configuration as those in the first embodiment, the same reference signs as those in the first embodiment will be given thereto, and the explanation thereof will be omitted.

This temporary tightening tool 2 according to the second embodiment is constituted by a grip part 100 and a socket part 200 formed at the tip of the grip part 100. In the grip part 100, ribs 12 for skid (slip resistance) are formed integrally in the outer circumference surface of the side walls 11 in the grip part 10 of the temporary tightening tool 1 according to the first embodiment. The ribs 12 are parts projected outward in the radial direction, are formed at equal intervals in a circumferential direction to extend along the axis direction. In addition, also in the first embodiment, the grip part 100 can also be adopted in place of the grip part 10.

The socket part 200 comprises leaf spring walls 50 in place of the leaf spring walls 40 of the temporary tightening tool 1 according to the first embodiment. The socket part 200 is formed in the shape of a hexagonal tube in which the torque transmission walls 30 and the leaf spring walls 50 are arranged by turns in the circumference direction. Space in a shape of a hexagonal tube surrounded by the torque transmission walls 30 and the leaf spring walls 50 is the room where the bolt head part HB1 is inserted, i.e., the head insertion space SP. The torque transmission walls 30 in the temporary tightening tool 2 are the same as the torque transmission walls 30 in the first embodiment.

A pair of two slits 51 are formed to reach a tip of each of the three leaf spring walls 50. Each of the slits 51 is an opening cut off to be narrow and long in a linear shape. The two slits 51 for each of the leaf spring walls 50 are formed a predetermined dimension away from each other in a width direction and parallel with each other. The leaf spring walls 50 express the side walls 11 in regions with the slits 51 formed therein among the six walls 11.

Each of the three leaf spring walls 50 is formed in a shape in which a tip side of a plate body between the two slits 51 is obliquely bent inward in the radial direction (without being bent in a shape of a U character). This plate body prepared between the two slits 51 can swing in the radial direction making a region between edges 51*a* of the two slits 51 as a base (fulcrum). Therefore, the plate body prepared between the two slits 51 functions as a leaf spring part which can be elastically deformed by force in the radial direction. This plate body prepared between the two slits 51 is equivalent to the leaf spring part in the present invention. Hereafter, this leaf spring part will be referred to as a hook part 52. The three hook parts 52 have a shape identical with each other.

A tip 52*a* of each of the hook parts 52 is formed at the same position the axis direction as the tip of the torque transmission wall 30 (torque transmission wall tip 30*a*). Therefore, an entry where the bolt head part HB1 is inserted is formed of the three tips 52*a* of the hook parts 52 and the three torque transmission wall tips 30*a*.

This tip 52*a* of the hook part 52 is a part which presses the side surface HB1*a* of the bolt head part HB1 inward in the radial direction. Hereafter, the tip 52*a* of the hook part 52 will be referred to as a hook pressing part 52*a*. End sides on an inner side in the radial direction of the three hook pressing parts 52*a* are formed so as to constitute three sides (alternate three sides) of a regular hexagon in an axial directional view. The above-mentioned regular hexagon is a regular hexagon smaller than a shape of an outer perimeter line of a cross-section of the bolt head part HB1 in its radial direction. The hook pressing parts 52*a* is configured such that the bolt head part HB1 can be smoothly inserted into the socket part 200.

By the bolt head part HB1 being inserted into the head insertion space SP of the socket part 200, the hook parts 52 are pressed by three side surfaces (a part of the side surfaces in the present invention) among the six side surfaces HB1*a* of the bolt head part HB1 to be elastically deformed outward in the radial direction, and imparts their restoring force to the three side surfaces. For this reason, the three hook parts 52 clamp the bolt head part HB1 with their own (leaf spring's) restoring force from three directions (three directions at equal intervals in a circumferential direction) to hold the bolt head part HB1.

This dimension by which the hook pressing parts 52*a* spread outward in the radial directions is the interference of the hook parts 52. Since the hook part 52 is a leaf spring, interference sufficient for absorbing the variation in the dimension of the bolt head part HB1 can be set. Therefore, the bolt head part HB1 is stably held by the three hook parts 52 after being inserted in the socket part 200.

As for the interference in the torque transmission wall 30, as with the first embodiment (including the modification), in a state where the bolt head part HB1 is inserted in the socket part 200, the side surface HB1*a* of the bolt head part HB1 may be prepared so as to be pressed against the internal side surface of the torque transmission wall 30 (internal wall surface 31*a* of the thick part 31), or may be designed such that a minute gap is prepared between the side surface HB1*a* of the bolt head part HB1 and the internal wall surface 31*a* of the torque transmission wall 30 and thereby the side surface HB1*a* of the bolt head part HB1 and the internal wall surface 31*a* of the torque transmission wall 30 do not contact with each other.

The maximum outside diameter of the socket part 200 is set to be smaller than the diameter of an opening on the entry side of the wheel mounting hole WH. Therefore, the tip of the socket part 200 can be inserted into the entry of the wheel mounting hole WH.

The usage of this temporary tightening tool 2 is the same as the usage of the temporary tightening tool 1 according to the first embodiment.

In this case, when the side surfaces HB1*a* of the bolt head part HB1 touch the internal wall surfaces 31*a* of the torque transmission walls 30 at a time point when the bolt head part HB1 is inserted into the socket part 200, the torque can be transmitted to the torque transmission walls 30 and the bolt head part HB1 can be rotated together with the socket part 200 from the moment when the grip part 100 is begun to be rotated. Moreover, since the torque transmission walls 30 can receive reaction force of the bolt head part HB1, the hook parts 52 can be prevented from receiving the reaction force from the bolt head part HB1. Therefore, the hub bolt HB can be rotated, without the hook parts 52 being twisted by the input of the torque.

On the other hand, in a case where the side surfaces HB1*a* of the bolt head part HB1 do not touch the internal wall surfaces 31*a* of the torque transmission walls 30 at the time point when the bolt head part HB1 is inserted into the socket part 200, the torque input into the grip part 100 is first transmitted to the bolt head part HB1 from the hook parts 52. When the torque is input, the hook parts 52 push the bolt head part HB1 in a direction of the torque, receive the reaction force from the bolt head part HB1 in association with this, and are twisted to the direction of the reaction force (elastically deformed).

And, the internal wall surfaces 31*a* of the torque transmission walls 30 come into contact with the bolt head part HB1 at a stage where the hook parts 52 are slightly twisted to the direction of the reaction force. Therefore, the torque transmission walls 30 can receive the reaction force of the bolt head part HB1 from the time point when the internal wall surfaces 31*a* of the torque transmission walls 30 come into contact with the bolt head part HB1 Thereby, the hook parts 52 do not receive any more reaction force from the time point when the internal wall surfaces 31*a* of the torque transmission walls 30 come into contact with the side surfaces HB1*a* of the bolt head part HB1. Therefore, the hook parts 52 can be regulated not to receive large reaction force from the bolt head part HB1.

In this way, the torque can be transmitted to the bolt head part HB1 using the thick parts 31 of the torque transmission walls 30 to tighten the hub bolt HB to the hub screw hole HR. Therefore, since the hook parts 52 are not used to tighten the hub bolt HB to the hub screw hole HH, the hook parts 52 hardly receive the reaction force of the input torque from the bolt head part HB1. For this reason, permanent set and abrasion of the hook parts 52 can be reduced.

As a result, in accordance with the temporary tightening tool 2 according to the second embodiment, since the function to hold the hub bolt HB is shared with the hook parts 52 and torque transmission function (which is also a function to receive the reaction force) to the hub bolt HB torque is shared with the torque transmission walls 30, the retention capacity for holding the hub bolt HB by the hook parts 52 can be maintained properly. Thereby, the hub bolt HB will not fall out of the socket part 20 in the temporary tightening operation, and workability can be improved.

Third Embodiment

Figure 12:
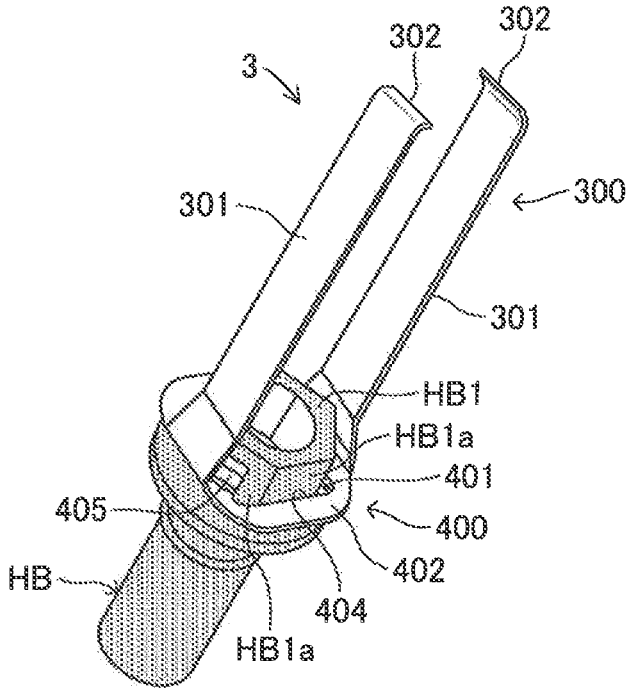
FIG. 12 is a perspective view for showing a state where a hub bolt is inserted into a tip of a temporary tightening tool for a fastening member according to a third embodiment.
Figure 13:
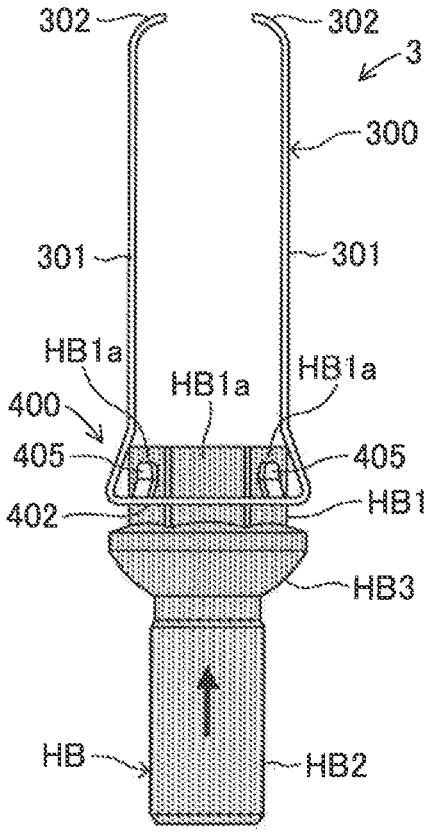
FIG. 13 is a front elevation of the temporary tightening tool for a fastening member according to the third embodiment.
Figure 14:
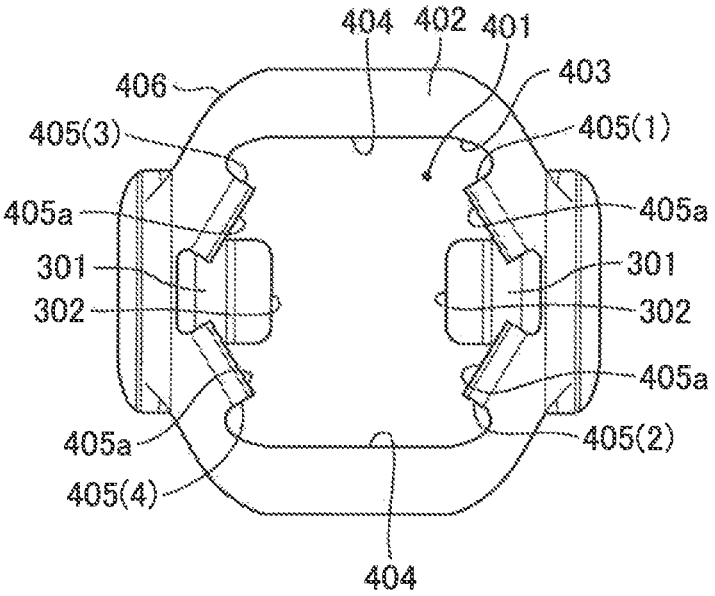
FIG. 14 is a bottom view of the temporary tightening tool for a fastening member according to the third embodiment.
Figure 15:
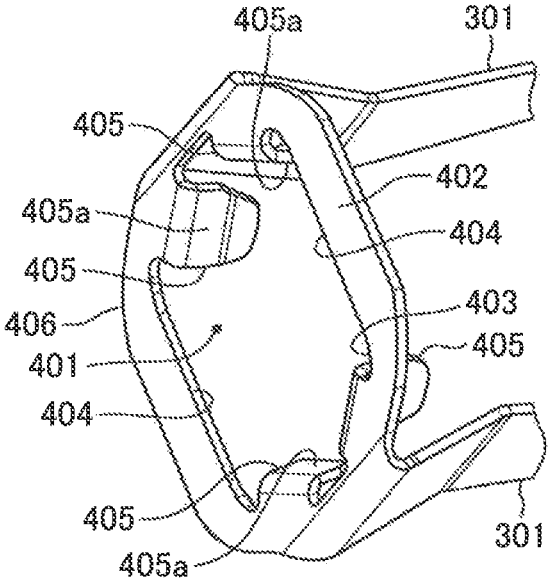
FIG. 15 is an enlarged perspective view of a socket part of the temporary tightening tool for a fastening member according to the third embodiment.

Next, a third embodiment of a temporary tightening tool will be explained. FIG. 12 to FIG. 15 are drawings for showing a temporary tightening tool for a fastening member according to a third embodiment, FIG. 12 is a perspective view for showing a state where a hub bolt is inserted in a tip of the temporary tightening tool for a fastening member, and FIG. 13 is a front elevation for showing a state where a hub bolt is inserted in a tip of the temporary tightening tool for a fastening member. FIG. 14 is a bottom view of the temporary tightening tool for a fastening member (bottom view of the temporary tightening tool for a fastening member observed from the direction of the arrow in FIG. 13), and FIG. 15 is an enlarged perspective view of a socket part of the temporary tightening tool for a fastening member. In addition, in FIG. 12 and FIG. 13, a hub bolt is indicated in gray in order to make it easier to distinguish the temporary tightening tool for a fastening member and the hub bolt.

This temporary tightening tool 3 according to the third embodiment is constituted by a grip part 300 and a socket part 400 formed at a Up of the grip part 300. The temporary tightening tool 3 is integrally formed of metallic plate, such as spring steel or stainless steel material.

The socket part 400 comprises a socket substrate 402 that is a metallic plate in a shape of a ring with an opening 401 formed in its center, as shown in FIG. 14 and FIG. 15. This opening 401 is an opening, into which said hexagonal columnar part is inserted, and is equivalent to the insertion hole in the present invention. The direction, in which the bolt head part HB1 is inserted into the opening 401 is the direction of the arrow shown in FIG. 13.

In this socket substrate 402, a pair of linear edges 404 formed linear and facing in parallel with each other are formed in the inner periphery 403 surrounding the opening 401. Distance between the two linear edges 404 is slightly larger than the width across flats of the bolt head part HB1. The linear edges 404 are edges of the socket substrate 402 which face parallel to the side surfaces HB1*a* (two side surfaces HB1*a* in parallel with each other) of the bolt head part HB1 with minute gaps when the bolt head part HB1 is inserted in the opening 401, are a part which transmits torque to the side surface HB1*a*, and are also a part which receives reaction force from the side surfaces HB1*a*. Therefore, in the socket substrate 402, the part in which the linear edges 404 are formed is equivalent to the torque transmission part in the present invention.

Hook parts 405 which are bent in the axis direction from four positions at the inner periphery 403 except the linear edge 404 and extend in the insertion direction of the bolt head part HB1 are formed in the socket substrate 402. The four hook parts 405 have a shape identical to each other, and extend to be slightly inclined inward in the radial direction, and can swing in the radial direction making a base (part connected with the socket substrate 402) as a fulcrum. Therefore, this hook part 405 functions as a leaf spring which can be elastically deformed by force in the radial direction. The hook part 405 is equivalent to the leaf spring part in the present invention.

As shown in FIG. 14, in an axial directional view, the socket part 400 comprises two pairs of the hook parts 405 which face in parallel with each other. In FIG. 14, reference signs 405 (1), 405 (2), 405 (3) and 405 (4) are given to them such that each of the four hook parts 405 can be specified. In an axial directional view, the four hook parts 405 are arranged such that the hook part 405 (1) and the hook part 405 (4) face in parallel with each other and the hook part 405 (2) and the hook part 405 (3) face in parallel with each other. The minimum distance between the surfaces 405*a* on inner sides in the radial direction of the hook parts 405 which faces in parallel with each other is designed to be smaller than the width across flats of the bolt head part HB1. Moreover, an angle between plate surfaces of the adjacent hook parts 405 (the hook part 405 (1) and the hook part 405 (2), as well as the hook part 405 (3) and the hook part 405 (4)) is 120 degrees. Therefore, the four hook parts 405 are formed such that the internal side surfaces 405*a* constitute a part of four sides of a regular hexagon in an axial directional view. The above-mentioned regular hexagon is a regular hexagon smaller than a shape of an outer perimeter line of a cross-section of the bolt head part HB1.

Thereby, when the bolt head part HB1 is inserted into the opening 401, the four hook parts 405 are respectively pressed by the side surfaces HB1*a* of the bolt head part HB1 to be elastically deformed outward in the radial direction, and impart their restoring force to the side surfaces HB1*a*. Therefore, the four hook parts 405 function as leaf springs which can be elastically deformed by force in the radial direction. The side surfaces HB1*a* of the bolt head part HB1 with which the four hook parts 405 come into contact are the four side surface HB1*a* except the two side surface HB1*a*, to which the linear edges 404 deliver torque, among the six side surfaces HB1*a*.

Moreover, the maximum outside diameter of the socket part 400, i.e., the maximum outside diameter of the socket substrate 402, is set to be smaller than the diameter of an opening on the entry side of the wheel mounting hole WH. Therefore, the tip of the socket part 400 can be inserted into the entry of the wheel mounting hole WH.

The grip part 300 comprises two grip boards 301 formed in a shape bent from two positions in the outer periphery 406 of the socket substrate 402 to be extended in a direction, into which the bolt head part HB1 is inserted. These two grip boards 301 are prepared so as to face mutually. Moreover, the two grip boards 301 are extended from the outer periphery 406 of the socket substrate 402 on an outer periphery side of the adjacent hook parts 405. Namely, the two grip boards 301 are extended from the outer periphery 406 such that centers in the width direction of the two grip boards 301 are at positions 90 degrees apart from the center position of the linear edge 404 in the circumference direction.

Since each of the grip boards 301 is prepared in a shape bent from the socket substrate 402, it is a leaf spring which can swing in a direction in which approaches to and estranges from each other, making its root part (part continuously connected with the socket substrate 402) as a fulcrum. The grip boards 301 are maintained in a positional relation in which the grip boards 301 face approximately in parallel with each other in a situation where external force is not input, as shown in FIG. 13.

A tail end of each of the grip boards 301 is bent inward in the radial direction to be in a shape of an L character. These parts bent in the shape of an L character are prepared as a tool for removing a decoration resin cap C. Hereafter, the parts bent in the shape of an L character will be referred to as a cap removing part 302.

As shown in FIG. 7, the decoration resin cap C covers the bolt head part HB1 to improve design by being fitted in the hub bolt HB bolt head part HB1. A groove (or level difference), which is not illustrated, is formed along the circumference direction in the outer circumference surface of the decoration resin cap C. The cap removing part 302 is formed in a shape of a hook so as to be able to be hooked on a side surface of this groove (or level difference). An operator can easily remove the decoration resin cap C from the bolt head part HB1 by clamping the groove of the decoration resin cap C with the cap removing part 302 and pulling the grip board 301.

In addition, the cap removing part 302 is not necessarily prepared in the temporary tightening tool 3.

When temporarily tightening the hub bolt HB (namely, when temporarily tightening the tire wheel W to the hub H), an operator inserts the bolt head part HB1 into the opening 401 of the socket part 400 of this temporary tightening tool 3. By this insertion operation, the four side surfaces HB1*a* of the bolt head part HB1 comes into contact with the internal side surfaces 405*a* of the hook part 405. Thereby, the hook parts 405 are elastically deformed to spread outward in the radial directions, and press the four side surfaces HB1*a* inward in the radial direction with restoring force. In this case, since the hook parts 405 press the two pairs of the side surfaces HB1*a* in parallel with each other among six side surface HB1*a* of the bolt head part HB1 with theft own restoring force, the hook parts 405 can hold the bolt head part HB1 stably.

This dimension by which the hook parts 405 spread outward in the radial directions is the interference of the hook parts 405. The interference of the hook parts 405 is set in consideration of variation in the width-across-flats dimension of the bolt head part HB1. Since the hook part 405 is a leaf spring, interference sufficient for absorbing the variation in the dimension of the bolt head part HB1 can be set. In this way, the bolt head part HB1 is stably held by the hook parts 405.

In the state where the bolt head part HB1 is inserted in in the opening 401 of the socket part 400, an operator inserts the hub bolt HB through the mounting hole WH of the tire wheel W, aligns the tip of the hub bolt HB to the hub screw hole HH, and rotates the grip part 300 around the axial center. Since the socket part 400 can be inserted into the entry of the mounting hole WH of the tire wheel W at this time, the tip of the hub bait HB can be made to reach the hub screw hole HH even when a shaft length of the hub bolt HB is not long enough.

By an operator turning the grip part 300, the torque is first transmitted to the bolt head part HB1 from the hook parts 405. The hook parts 405 push the bolt head part HB1 in a direction of the torque, receives reaction force from bolt head part HB1 in association with this, and are twisted to a direction of reaction force (elastically deformed). And, the two linear edges 404 of the socket substrate 402 come into contact with the bolt head part HB1 at a stage where the hook parts 405 are slightly twisted to the direction of the reaction force. Therefore, the linear edges 404 of the socket substrate 402 can receive the reaction force of the bolt head part HB1 from the time point when the linear edges 404 come into contact with the bolt head part HB1. Thereby, the hook parts 405 do not receive any more reaction force from the time point when t the linear edges 404 come into contact with the side surfaces HB1*a* of the bolt head part HB1. Therefore, the hook parts 405 can be regulated not to receive large reaction force from the bolt head part HB1.

In this way, the torque can be transmitted to the bolt head part HB1 using the linear edges 404 of the socket substrate 402 to tighten the hub bolt HB to the hub screw hole HH. Therefore, since the hook parts 405 are not used to tighten the hub bolt HB to the hub screw hole HH, the hook parts 405 hardly receive the reaction force of the input torque from the bolt head part HB1. For this reason, permanent set (settling) and abrasion of the hook parts 405 can be reduced.

As a result, in accordance with the temporary tightening tool 3 according to the third embodiment, since the function to hold the hub bolt HB is shared with the hook parts 405 and torque transmission function to the hub bolt HB (which is also a function to receive the reaction force) is shared with the linear edge 404, the retention capacity of the hook parts 405 for holding the hub bolt HB can be maintained properly. Thereby, the hub bolt HB will not fall out of the socket part 400 in the temporary tightening operation, and workability can be improved.

Moreover, since an operator grasps the grip part 300 lightly, the tip sides of the two grip boards 301 are displaced in a direction mutually approaching (inward in the radial direction) when temporarily tightening the hub bolt HB. In association with this, the socket substrate 402 curves a little, and the four hook parts 405 is energized to a direction falling to the side surface HB1*a* of the bolt head part HB1. Namely, force for displacing the tip sides of the four hook parts 405 inward in the radial direction works. This is because the four hook parts 405 are prepared at positions inside in the radial direction of the grip boards 301 in the socket substrate 402. For this reason, force for holding the bolt head part HB1 is further increased by force for grasping the grip part 300. Therefore, the bolt head part HB1 can be held much more stably.

Although the temporary tightening tools for a fastening member according to the embodiments of the present inventions have been explained as the above, the present invention is not limited to the above-mentioned embodiments, and various modifications are possible unless they deviates from the objective of the present invention.

Figure 16:
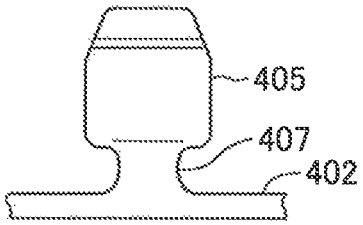
FIG. 16 is a diagram for showing a modification of a hook part of the temporary tightening tool for a fastening member according to the third embodiment.
Figure 17:
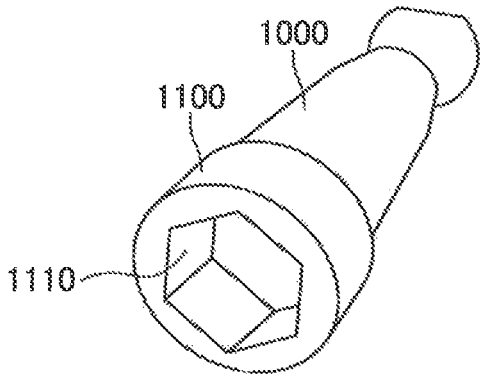
FIG. 17 is a perspective view of a conventional temporary tightening tool for a fastening member.
Figure 18:
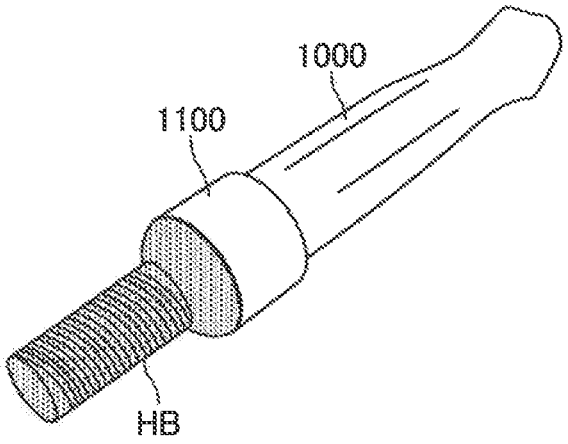
FIG. 18 is a perspective views for showing a state where a hub bolt is inserted into the conventional temporary tightening tool for a fastening member.

For example, in the third embodiment, a constriction (neck) part 407 may be formed in the base of the hook part 405, as shown in FIG. 16. In this case, stiffness of the hook part 405 can be lowered and more excellent spring nature can be obtained. For this reason, the bolt head part HB1 can be smoothly inserted into the socket part 400, and the bolt head part HB1 can be held stably.

For example, in the first embodiment and the second embodiment, the socket parts 20 (200) may be formed in the both ends of the grip part 10 (100). In this case, the socket parts 20 (200) formed in both ends may correspond to the hub bolts HB with sizes (width across flats) identical to each other, or may correspond to the hub bolts HB with sizes (width across flats) from each other.

For example, although the tightening tools 1, 2 and 3 according to the present embodiment are used for a vehicle of a type, in which the hub bolt HB is screwed to the hub screw hole HH of the hub H to fix a tire wheel to a hub, they can be used for a vehicle of a type, in which a stud bolt is being fixed to the hub H and a nut is screwed from a tip of the stud bolt to fix a tire wheel to a hub, instead. In this case, a fastening member is a nut. Therefore, it is preferable that a tightening tool comprises a socket part, in which a nut is inserted, and is configured to press a part of side surfaces among six side surfaces of the nut inward in a radial direction with leaf spring parts to hold the nut and transmit torque to the side surfaces which are not pressed by the leaf spring parts among the six side surfaces of the nut from a torque transmission part.

REFERENCE SIGNS LIST

1, 2, 3: Temporary Tightening Tool, 10: Grip Part, 11: Side Wall, 11*a*: Internal wall surface, 20: Socket Part, 30: Torque Transmission Wall (Torque Transmission Part), 31: Thick Part, 31*a*: Internal wall surface, 40: Leaf Spring Wall, 41: Slit, 42: Hook Part (Leaf Spring Part), 42*b*: Hook Pressing Part, 50: Leaf Spring Wall, 51: Slit, 52: Hook part (Leaf Spring Part), 52*a*: Hook Pressing Part, 100: Grip Part, 200: Socket Part, 300: Grip part, 301: Grip Board, 400: Socket Part, 401: Opening (insertion Hole), 402: Socket Substrate, 403: Inner Periphery, 404: Linear Edge (Torque Transmission Part), 405: Hook Part (Leaf Spring Part), 405*a*: Internal Side Surface, 406: Outer Periphery, H: Hub, HB: Hub Bolt (Fastening Member), HB1: Bolt Head (Hexagonal columnar part), HB1*a*: Side Surface, HH: Hub Screw Hole, SP: Head Insertion Space, W: Tire Wheel, WH: Wheel Mounting hole.

The invention claimed is:

1. A temporary tightening tool for a fastening member, which is used for temporarily tightening a fastening member that is a bolt or nut for fastening a tire wheel to a hub, comprising;

a grip part for an operator to input torque, and a socket part formed at a tip of said grip part, into which a hexagonal columnar part formed at said fastening member is inserted, wherein:

said socket part comprises;

a leaf spring part which is pressed by a part of six side surfaces of said hexagonal columnar part to be elastically deformed outward in a radial direction of said hexagonal columnar part when said hexagonal columnar part is inserted in said socket part, and presses said part of said six side surfaces inward in the radial direction with restoring force to hold said hexagonal columnar part such that said hexagonal columnar part is clamped, and a torque transmission part which transmits torque to a side surface that is not pressed by said leaf spring part among said six side surfaces of said hexagonal columnar part when said torque is input into said grip part in a state where said hexagonal columnar part has been inserted in said socket part, wherein:

said socket part is formed in a shape of a hexagonal tube surrounded by six side walls, two slits are formed a predetermined dimension away from each other in a width direction to reach a tip of said side wall along an axis direction in each of alternate three side walls among said six side walls, said leaf spring part is a plate body formed between said two slits, and said torque transmission part is prepared in each of three remaining side walls without said slits among said six side walls, in which a thick part with plate thickness thicker than said leaf spring part is formed.

2. The temporary tightening tool for a fastening member, according to claim 1, wherein:

said leaf spring part is formed in a shape in which a tip side of said plate body between said slits is inclined inward in the radial direction, and is configured such that this inclined tip of said plate body presses the side surface of said hexagonal columnar part inward in the radial direction.

3. The temporary tightening tool for a fastening member, according to claim 1, wherein:

said leaf spring part is formed in a shape in which said plate body between said slits is bent inward in the radial direction in a shape of a U character, and is configured such that this tip of said plate body bent in the shape of a U character presses the side surface of said hexagonal columnar part inward in the radial direction.

4. A temporary tightening tool for a fastening member, which is used for temporarily tightening a fastening member that is a bolt or nut for fastening a tire wheel to a hub, comprising;

a grip part for an operator to input torque, and a socket part formed at a tip of said grip part, into which a hexagonal columnar part formed at said fastening member is inserted, wherein:

said socket part comprises;

a leaf spring part which is pressed by a part of six side surfaces of said hexagonal columnar part to be elastically deformed outward in a radial direction of said hexagonal columnar part when said hexagonal columnar part is inserted in said socket part, and presses said part of said six side surfaces inward in the radial direction with restoring force to hold said hexagonal columnar part such that said hexagonal columnar part is clamped, and a torque transmission part which transmits torque to a side surface that is not pressed by said leaf spring part among said six side surfaces of said hexagonal columnar part when said torque is input into said grip part in a state where said hexagonal columnar part has been inserted in said socket part, wherein:

said socket part comprises a socket substrate that is a metallic plate in a shape of a ring with an insertion hole, into which said hexagonal columnar part is inserted, said leaf spring part is formed in a shape which is bent from a plurality of predetermined positions in an inner periphery surrounding said insertion hole of said socket substrate to be extended in a direction, into which said hexagonal columnar part is inserted, said torque transmission part is formed at a position in said inner periphery of said socket substrate where said leaf spring part is not formed, and said grip part is formed in a shape which is bent from an outer periphery of said socket substrate to be extended in a direction, into which said hexagonal columnar part is inserted.

5. The temporary tightening tool for a fastening member, according to claim 4, wherein:

said torque transmission part comprises two linear edges formed in a linear shape and facing in parallel with each other in said inner periphery of said socket substrate and configured so as to transmit torque to two mutually parallel side surfaces among said six side surfaces of said hexagonal columnar part when said torque is input into said grip part in a state where said hexagonal columnar part is inserted in said insertion hole, and said leaf spring part is configured to be pressed by four side surfaces, excluding said two mutually parallel side surfaces, among said six side surfaces of said hexagonal columnar part to be elastically deformed outward in the radial direction of said hexagonal columnar part, and presses said four side surfaces inward in the radial direction with restoring force to hold said hexagonal columnar part such that said hexagonal columnar part is clamped, when said hexagonal columnar part is inserted in said insertion hole.

* * * * *